United States Patent [19]

Inumada

[11] Patent Number: 4,900,885

[45] Date of Patent: Feb. 13, 1990

[54] HIGH FREQUENCY HEATING SYSTEM WITH CHANGING FUNCTION FOR RATED CONSUMPTION POWER

[75] Inventor: Masato Inumada, Nagoya, Japan

[73] Assignee: Kabushiki Kaisha Toshiba, Kawasaki, Japan

[21] Appl. No.: 310,915

[22] Filed: Feb. 15, 1989

[30] Foreign Application Priority Data

Feb. 16, 1988 [JP] Japan ..... 63-33425

[51] Int. Cl.[4] ..... H05B 6/68

[52] U.S. Cl. ..... 219/10.55 B; 219/10.55 M; 219/10.77; 363/21

[58] Field of Search ..... 219/10.55 B, 10.55 R, 219/10.55 M, 10.77; 363/21; 323/281, 351

[56] References Cited

U.S. PATENT DOCUMENTS

| | | | |
|---|---|---|---|
| 4,002,875 | 1/1977 | Kiuchi et al. | 219/10.55 B |
| 4,349,777 | 9/1982 | Mitamura | 323/281 X |
| 4,456,807 | 6/1984 | Ogino et al. | 219/10.77 |
| 4,467,165 | 8/1984 | Kiuchi et al. | 219/10.77 |
| 4,533,810 | 8/1985 | Harmon et al. | 219/10.55 B |
| 4,540,866 | 9/1985 | Okuda | 219/10.77 |
| 4,580,025 | 4/1986 | Carlson et al. | 219/10.55 B |
| 4,724,291 | 2/1988 | Inumada | 219/10.55 B |
| 4,777,575 | 10/1988 | Yamato et al. | 363/21 |

FOREIGN PATENT DOCUMENTS

| | | |
|---|---|---|
| 26033A1 | 4/1981 | European Pat. Off. . |
| 99705A2 | 2/1984 | European Pat. Off. . |
| 39072A2 | 9/1987 | European Pat. Off. . |
| 55-33593 | 8/1980 | Japan . |
| 1486999 | 9/1977 | United Kingdom . |
| 1542662 | 3/1979 | United Kingdom . |
| 2062985A | 5/1981 | United Kingdom . |
| 2073967A | 10/1981 | United Kingdom . |
| 2166916A | 5/1986 | United Kingdom . |

*Primary Examiner*—Philip H. Leung

*Attorney, Agent, or Firm*—Cushman, Darby & Cushman

[57] ABSTRACT

A high frequency heating apparatus includes a high frequency heating source for outputting a predetermined maximum rated high frequency output. An inverter circuit receives an AC input and supplies a predetermined high frequency drive power to the high frequency heating source. A switch manually changes and outputs a plurality of rated consumption power change signals including at least two levels corresponding to the maximum rated high frequency output of the high frequency heating source and at least one high frequency output lower than the maximum rated high frequency output, associated with a rated consumption power of the apparatus. A controller controls the high frequency drive power from the inverter circuit in accordance with the rated consumption change signal from the switch. The high frequency output from the high frequency heating source and the rated consumption power of the apparatus are linearly, variably set in accordance with the rated consumption power change signal.

5 Claims, 4 Drawing Sheets

HIGH FREQUENCY HEATING SYSTEM WITH CHANGING FUNCTION FOR RATED CONSUMPTION POWER

Background of the Invention

1. Field of the Invention

This invention relates to a high frequency heating system with a changing function for a rated consumption power and, more particularly, to a system suitably applied to a microwave oven or electromagnetic cooker utilizing high frequency heating.

2. Description of the Related Art

In a cooker utilizing high frequency heating such as a microwave oven having a magnetron as a heating source, a ratio between a high frequency output and a consumption power is about 1 : 2. For this reason, as in an electric power utility of Japan, a microwave oven having a rated high frequency output of up to 400 W (rated consumption power of about 800 W) can be used in a user house having a contract current value (breaker activation current value) of 10 A (100 V). Similarly, in a user's house having a contract current value of 15 A (100 V), a microwave oven having a rated high frequency output of 500 W (rated consumption power of about 1,000 W) or 600 W (rated consumption power of about 1,200 W) can be used.

In this case, however, if a user moves to a new address, for example, and a contract current value of a house at the new address is not 15 A but 10 A, a currently-used microwave oven having a rated high frequency output of 500 W or 600 W can no longer be used.

This is because a conventional high frequency heating apparatus of this type generally controls power supply by duty ratio control without an inverter circuit. That is, a conventional apparatus performs output control by a duty ratio between power supply ON and OFF, and the peak value of a consumption power is constant regardless of a rated high frequency output of a microwave oven.

In the above case, the user must request a modification of a contract for, increasing a contract current value up to 15 A or more and wait for electrical work to be executed by an electric power company.

Also, in addition to a microwave oven, electric apparatuses such as a refrigerator and a rice cooker are generally used in a user's house. Therefore, even if a contract current value of a user's house is high, 15 A, a power source breaker of the user's house may be activated when a microwave oven is used simultaneously with other electric apparatuses.

Note that in an electric power utility of Japan, a coefficient of an electric fee per month is increased as a contract current value is increased. For this reason, users tend to maintain a contract current value as small as possible.

In an electric power utility of, e.g., the U.S.A., wherein a user's current value is not limited by a contract unlike in the electric power utility of Japan, the following problem arises.

That is, an outlet (including a so-called table tap) to which an electric apparatus is connected has a predetermined rated power. This is to prevent a fire or the like due to overheating of the power source outlet even if electric apparatuses including an microwave oven having a consumption current exceeding a rated power of an outlet are simultaneously connected thereto.

In this case, a user must additionally provide a power source outlet having an adequate rated power for only a microwave oven.

SUMMARY OF THE INVENTION

It is, therefore, an object of the present invention to provide a new improved high frequency heating system with a changing function for a rated consumption power which can be used at an adequate rated consumption power regardless of a power source capacity or whether or not another electric apparatus is used.

According to the present invention, there is provided a high frequency heating apparatus comprising:

a high frequency heating source having a predetermined maximum rated high frequency output;

inverter means for receiving an AC input and supplying a predetermined high frequency drive power to the high frequency heating source, the inverter means including rectifying means for rectifying the AC input and a switching element for switching a DC output from the rectifying means;

changing means for manually changing and outputting a plurality of rated consumption power change signals including at least two levels corresponding to the maximum rated high frequency output of the high frequency heating source and at least one high frequency output lower than the maximum rated high frequency output, associated with a rated consumption power of the apparatus; and control means for controlling the high frequency drive power from the inverter means in accordance with the rated consumption change signal from the changing means, the high frequency output from the high frequency heating source and the rated consumption power of the apparatus being linearly, variably set in accordance with the rated consumption power change signal.

BRIEF DESCRIPTION OF THE DRAWINGS

These and other objects and features of the present invention can be understood through the following embodiment by reference to the accompanying drawings, in which.

DETAILED DESCRIPTION OF THE PREFERRED EMBODIMENT

An embodiment in which the present invention is applied to a microwave oven will be described below with reference to the accompanying drawings.

Figure 1:
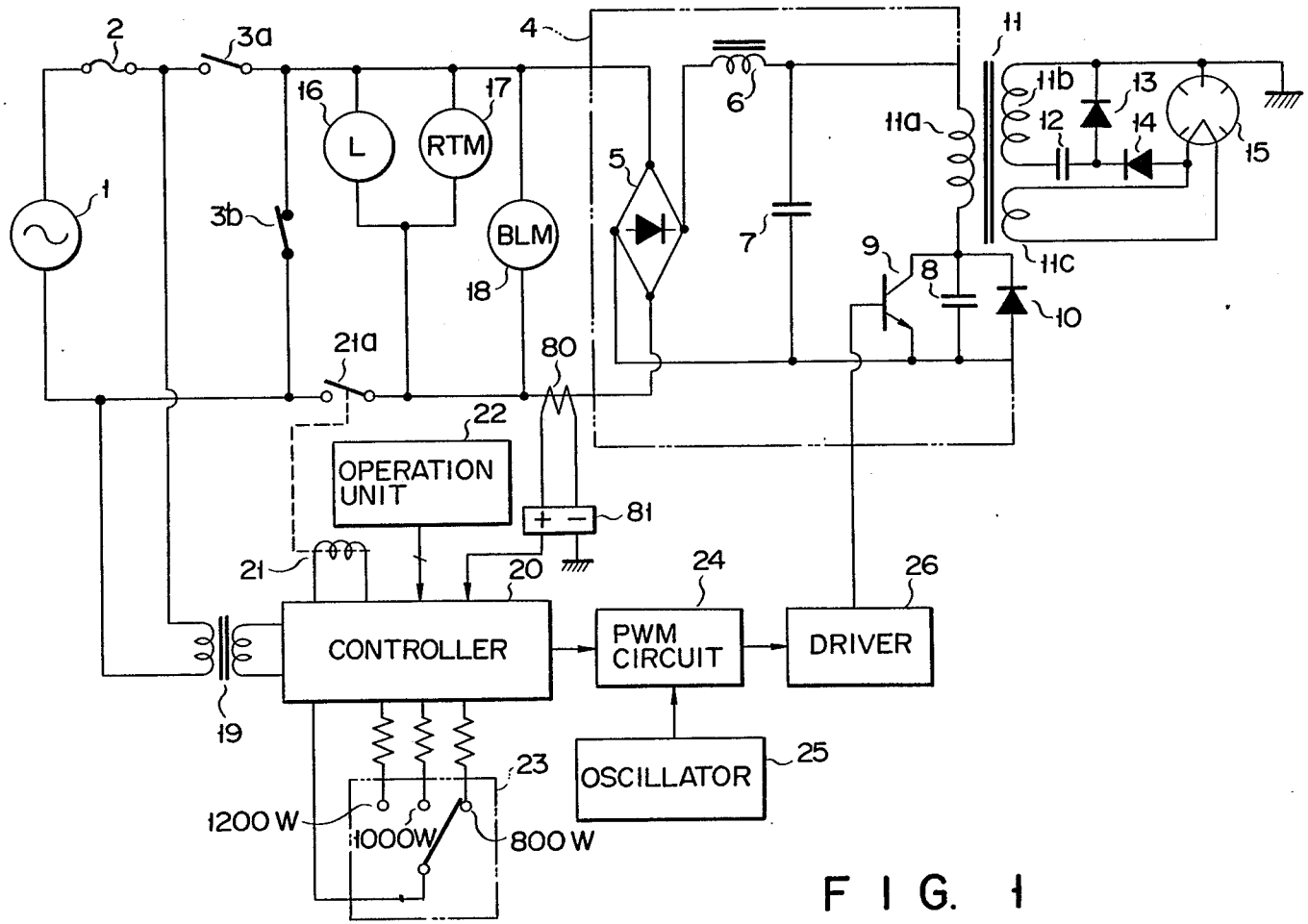
FIG. 1 is a circuit diagram showing an arrangement of a controller of a microwave oven according to an embodiment of the present invention.

Referring to FIG. 1 showing a controller of a microwave oven, reference numeral 1 denotes a commercial AC power source. A door monitor switch (short-circuit switch) **3*b* is connected to the power source 1 via a fuse 2 and a door switch 3*a***.

An inverter circuit 4 is also connected to the power source 1 via the fuse 2, the door switch 3*a* and a relay contact 21*a*.

The inverter circuit 4 includes a rectifying circuit comprising a diode bridge circuit 5, a choke coil 6 and a smoothing capacitor 7. A series resonant circuit comprising a primary coil 11*a* of a high voltage transformer 11 and a resonant capacitor 8 is connected to the output terminal of the rectifying circuit. The collector - emitter path of a switching element such as an NPN transistor 9 and a damper diode 10 are connected in parallel with the capacitor 8.

The transistor 9 excites the resonant circuit by its ON/OFF operation, and a high frequency current having a predetermined frequency (e.g., several tens kHz) is flowed through the primary coil 11*a* of the transformer 11 upon excitation of the circuit.

The anode - cathode path of a magnetron 15 is connected to a secondary coil 11*b* of the transformer 11 via a voltage doubler rectifying circuit comprising a high voltage capacitor 12 and high voltage diodes 13 and 14. The anode of the magnetron 15 is grounded, and its heater (cathode) is connected to the secondary coil 11*b* of the transformer 11. In this case, assume that the magnetron 15 can heat an object to be heated up to a maximum high frequency output (of a microwave range) of 600 W, and that the inverter circuit 4 can supply under the PWM control described above a power required for the magnetron 15 to radiate a maximum high frequency output of 600 W.

A heating chamber illumination lamp (internal light) 16 is connected to the power source 1 via the fuse 2, the door switch 3*a* and the relay contact 21*a*. A turntable driving motor 17 is connected in parallel with the lamp 16.

A magnetron cooling blower motor 18 is connected to the power source 1 via the fuse 2, the door switch 3*a* and the relay contact 21*a*.

The primary coil of a step-down transformer 19 is also connected to the power source 1 via the fuse 2, and its secondary coil is connected to a control unit 20.

The control unit 20 controls the entire cooker and comprises a power source circuit, a microcomputer incorporating an A/D converter, a relay driver and the like. The unit 20 is connected to a relay 21, an operation unit 22, a switch 23 and a pulse width modulator (PWM circuit) 24. The control unit 20 controls driving of the relay 21 upon an operation of the operation unit 22 having a cooking time setting section, a start switch and the like, and generates a rated consumption power switch signal (output set signal) having a voltage level corresponding to the setting of the switch 23.

The switch 23 is a changing means for changing one of three levels of a rated consumption power of 800 W, 1,000 W and 1,200 W and located at a position enabling an easy operation of a user, e.g., at an operation panel of a microwave oven main body (not shown).

The pulse width modulator 24 pulse-width-modulates a sawtooth signal generated from an oscillator 25 in accordance with the output set signal generated from the controller 20.

A driver (base driver) 26 is connected to the output terminal of the modulator 24. The driver 26 turns on/off the transistor 9 of the inverter circuit 4 in accordance with an output from the modulator 24.

A current transformer 80 is connected to an input line to the inverter circuit 4. The transformer 80 together with a bridge rectifier 81 for rectifying an output therefrom constitute an input current detecting means. An output from the rectifier 81 is supplied to the controller 20.

Figure 2:
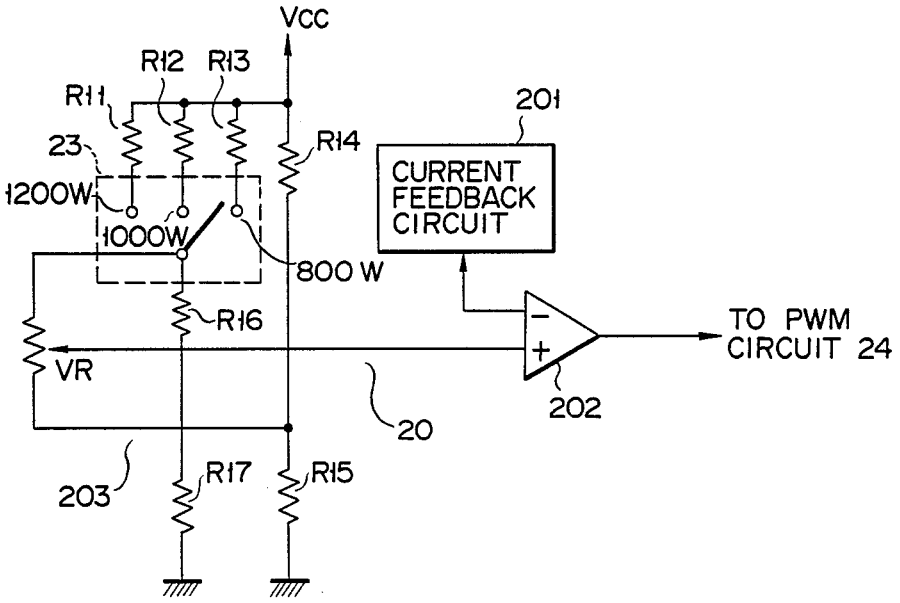
FIG. 2 is a circuit diagram showing an equivalent analog connection between a switch and a control unit.

FIG. 2 shows an equivalent analog connection circuit between the switch 23 and the main part of the controller 20. That is, an output from the input current detecting means is supplied as an output from a current feedback circuit 201 to one input terminal of a comparator 202. The other input terminal of the comparator 202 receives an output from a rated output switching circuit 203 connected between a DC power source Vcc and ground as shown in FIG. 2 and comprising the switch 23, resistors R11 to R17 and a slide-volume-type variable resistor VR. An output from the comparator 202 is supplied to the pulse width modulator 24.

Figure 3:
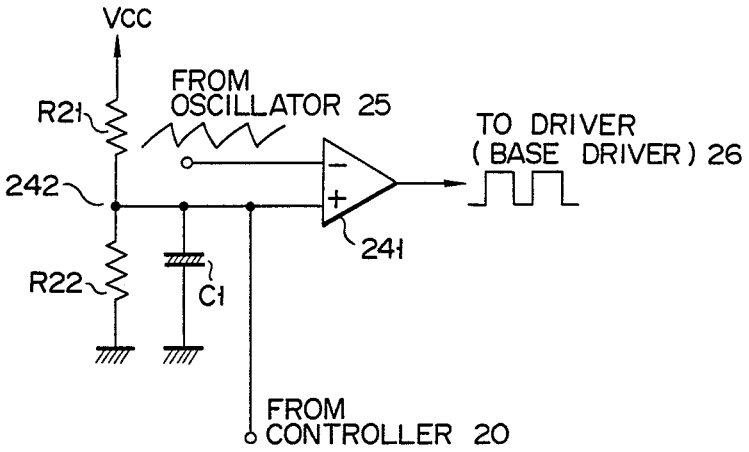
FIG. 3 is a circuit diagram showing an embodiment of a PWM circuit shown in FIG. 1.

FIG. 3 shows an embodiment of the pulse width modulator. The output from the controller 20 is supplied to one input terminal of a comparator 241. The other input terminal of the comparator 241 receives the sawtooth output from the oscillator 25. A bias voltage from a biasing circuit 242 comprising resistors R21 and R22 connected between the power source Vcc and ground is superposed on the one input terminal of the comparator 241 via a capacitor Cl. An output from the comparator 241 is supplied to the driver (base driver) 26.

An operation of the above arrangement will be described below with reference to FIGS. 4A to 4E and FIG. 5.

A user places a food on a turntable in a heating chamber (not shown) and sets a desired cooking time by the operation unit 22. The user then performs a cooking start operation by the operation unit 22.

The controller 20 excites the relay 21 to turn on the contact 21*a*, thereby forming a power supply path to the inverter circuit 4.

The controller 20 generates an output set signal having a voltage level corresponding to a set position of the switch 23 set by the user as will be described later. Types of the output set signal are $V_1$, $V_2$ and $V_3$ corresponding to rated consumption powers of about 1,200 W, 1,000 W and 800 W, respectively.

Figure 4:
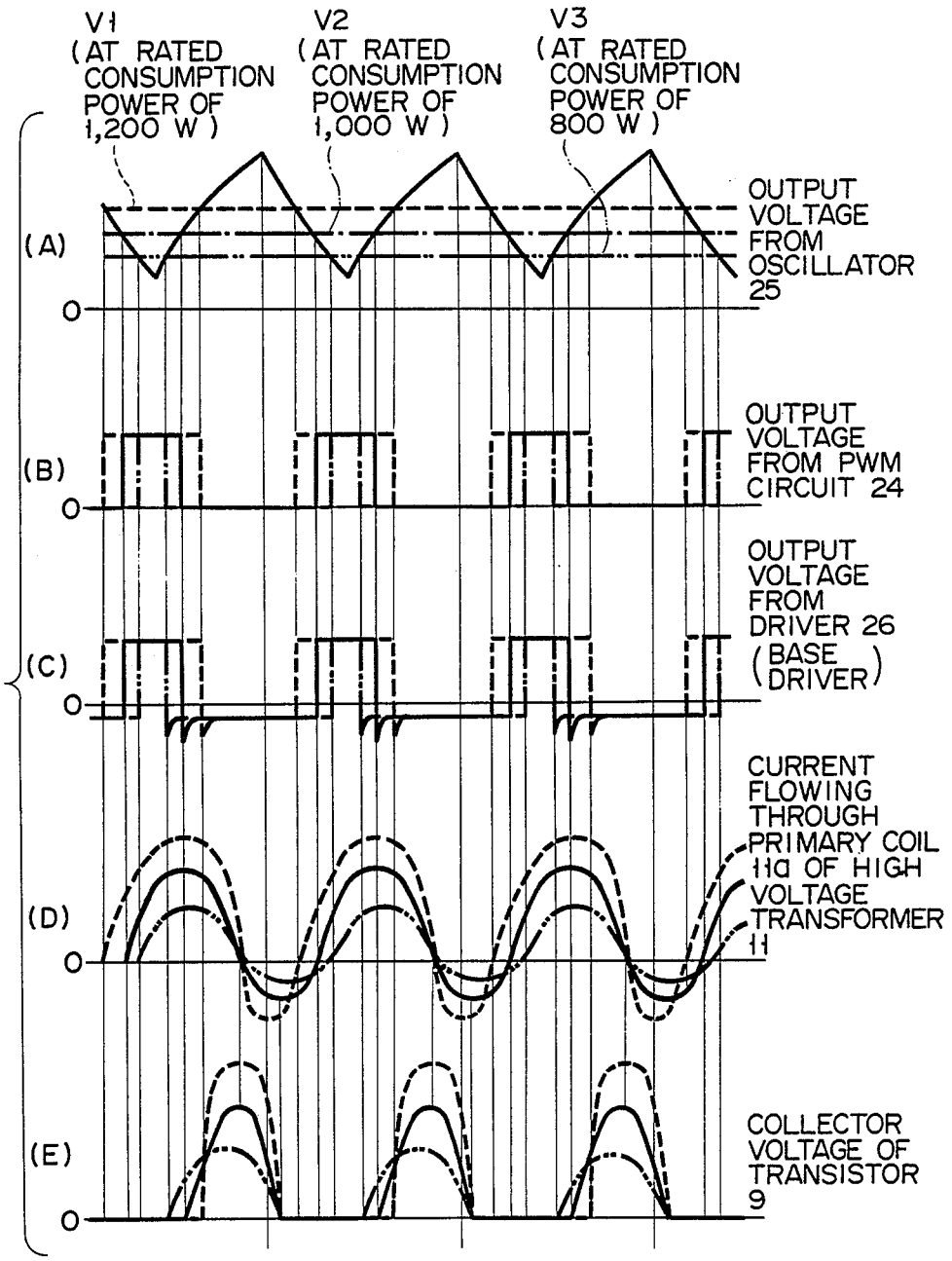
FIGS. 4A to 4E are timing charts showing waveforms of the respective units for explaining an operation of the circuit shown in FIG. 1.

The oscillator 25 generates a sawtooth signal (FIG. 4A). The sawtooth signal is pulse-width-modulated by the pulse width modulator 24 on the basis of the above output set signal (FIG. 4B).

In this manner, the driver 26 turns on/off the transistor 9 on the basis of an output from the modulator 24 (FIGS. 4C and 4E). When the transistor 9 is turned on/off, the resonant circuit is excited to flow a high frequency current (FIG. 4D) through the primary coil 11*a*, and the magnetron 15 oscillates. That is, a high frequency electric wave having a predetermined energy is radiated in the heating chamber to start cooking.

When the predetermined cooking time has elapsed, the controller 20 deenergizes the relay 21 to stop power supply to the inverter circuit 4, thereby ending the cooking.

In the above operation, upon activation of the inverter circuit 4, the input current to the inverter circuit 4 is detected by the current transformer 80, and a DC voltage corresponding to the detected current is supplied from the bridge rectifier 81 to the controller 20.

The controller 20 calculates an average or effective value of the input current to the inverter circuit 4 in accordance with the output from the rectifier 81. If the calculated value becomes smaller than a set value (corresponding to the set output), the controller 20 increases the level of the output set signal to prolong an ON period of the transistor 9 of the inverter circuit 4. On the contrary, if the calculated value becomes larger than the set value, the controller 20 decreases the level of the output set signal to shorten the ON period of the transistor 9.

When the ON period of the power transistor 9 is prolonged, the high frequency current flowing through the primary coil 11*a* of the high voltage transformer 11 is increased to increase the output. When the ON period is shortened, the high frequency current flowing through the coil 11*a* of the transformer 11 is decreased to decrease the output.

In this manner, during high frequency dielectric (microwave) heating performed by the magnetron, the output can be maintained at a set output regardless of the temperature change of the magnetron 15, thereby properly performing heating.

If a power source capacity (contract current value) of a user's house is low, 10 A, a user sets the switch 23 at a position of the rated consumption current of 800 W. The controller 20 generates the output set signal $V_3$ having a lower level (indicated by an alternate long and two dashed line in FIG. 4A), and the modulator 24 generates a pulse signal in which a logic "1" period is not so long (indicated by an alternate long and two dashed line in FIG. 4B), thereby decreasing the output from the inverter circuit 4, i.e., the current (indicated by an alternate long and two dashed line in FIG. 4D) flowing through the primary coil 11*a* of the transformer 11. As a result, this microwave oven can be used at a high frequency output of 400 W and a rated consumption current of about 800 W.

If a power source capacity (contract current value) of a user's house is high, 15 A, a user sets the switch 23 at a position of the rated consumption current of 1,000 or 1,200 W. The controller 20 generates the output set signal $V_2$ or $V_1$ (indicated by an alternate long and dashed line or broken line in FIG. 4A) and the modulator 24 generates a pulse signal in which a logic "1" period is long (indicated by solid and broken lines in FIG. 4B), thereby increasing the output from the inverter circuit 4, i.e., the current (indicated by solid and broken lines in FIG. 4D) flowing through the coil 11*a* of the transformer 11. As a result, this microwave oven can be used at a high frequency output of 500 or 600 W and a rated consumption power of about 1,000 or 1,200 W.

Figure 5:
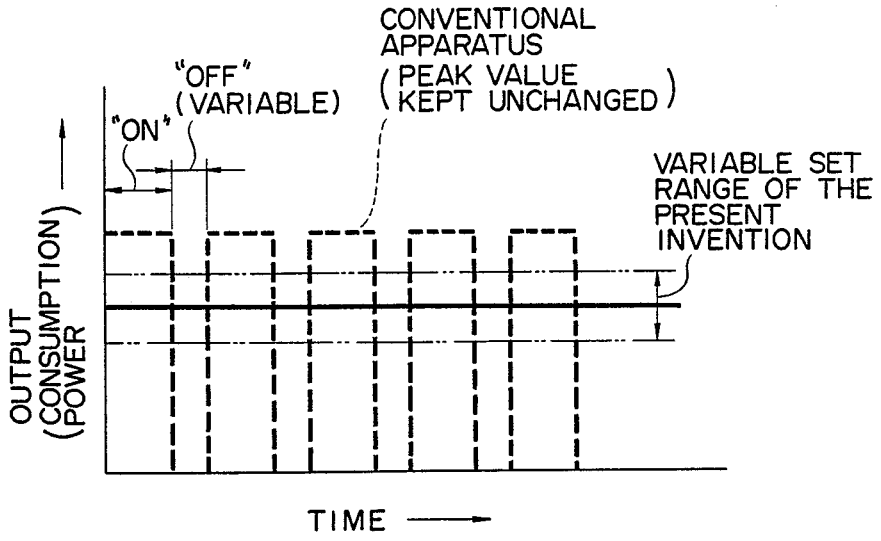
FIG. 5 is a graph comparing operations of a conventional apparatus and an apparatus according to the present invention.

FIG. 5 is a graph in which operations of a conventional apparatus and the apparatus according to the present invention are compared. That is, in an output (consumption power) from a microwave oven without a inverter circuit, only an OFF period of power supply ON/OFF control of a conventional apparatus by duty ratio control is variable, and a peak value of the output (consumption power) is kept unchanged. To the contrary, an apparatus according to the present invention, linear output (consumption power) characteristics can be obtained for both the factors within predetermined variable ranges since having a rated consumption change switch and an inverter circuit for a high frequency drive power.

In this manner, a user can set the rated consumption power of the microwave oven to be an adequate value in accordance with a power source capacity (contract current value) of a user's house. That is, although the microwave oven of the present invention utilizes the inverter circuit, the overall consumption power can be selectively decreased below a predetermined value. Therefore, even if a power source capacity (contract current value) of a user's house is changed by, e.g., moving, the microwave oven can be used by setting an adequate rated consumption power without being adversely affected by the power source capacity change. That is, the user need not stop using the microwave oven and wait for electrical work to be executed by an electric power company for increasing the power source capacity of the user's house.

When the rated consumption power of the microwave oven is set to be 800 W, cooking performance may be degraded because the high frequency output is decreased from 600 to 400 W. In actual cooking, however, only a cooking time becomes slightly longer in the cooking at 400 W than that in the cooking at 600 W, and the cooking performance is not adversely affected. In some cases, since heating can be uniformly performed because the cooking time is prolonged, the cooking performance is even improved.

In addition, even if a power source capacity (contract current value) of a user's house is 15 A, a user may use other electric apparatuses at the same time. In this case, the rated consumption power of the microwave oven is switched to be a small value to prevent activation of a power source breaker of the user's house.

Note that in FIG. 4D, the frequency of the coil current is kept constant regardless of the value of the rated consumption power. In an actual operation, however, the frequency may be offset by about 5 kHz.

In the above embodiment, the number of switching levels of the rated consumption power is three. The number of switching levels is, however, not limited to this one. In addition, the present invention is not limited to the above embodiment but can be variously modified, e.g., applied to an electromagnetic cooker without departing from the spirit and scope of the present invention.

As has been described above, a high frequency heating apparatus according to the present invention comprises the high frequency heating source, the inverter circuit for supplying a drive power to the high frequency heating source, the changing means for changing and setting a rated consumption power of the apparatus, and the control means for controlling an output from the inverter circuit in accordance with a set content of the changing means, so that the high frequency output and rated consumption power can be linearly, variably set. Therefore, the high frequency heating apparatus is provided which can be used by changing the rated consumption power to be an adequate value regardless of a power source capacity of a user's house or whether or not another electric apparats is used.

What is claimed is:

1. A high frequency heating apparatus comprising:

a high frequency heating source having a predetermined maximum rated high frequency output;

inverter means for receiving an AC input and supplying a predetermined high frequency drive power to said high frequency heating source, said inverter means including rectifying means for rectifying the AC input and a switching element for switching a DC output from said rectifying means;

changing means for manually changing and outputting a plurality of rated consumption power change signals, said changing means including at least two levels corresponding to the maximum rated high frequency output of said high frequency heating source and at least one high frequency output lower than the maximum rated high frequency output, associated with a rated consumption power of said apparatus; and control means for controlling the high frequency drive power from said inverter means in accordance with the rated consumption change signal from said changing means, the high frequency output from said high frequency heating source and the rating consumption power of said apparatus being linearly, variably set in accordance with the rated consumption power change signal, said control means including an AC input detecting means for detecting the AC input to said inverter means, comparing means for comparing a detection output from said AC input detecting means with a reference signal, control signal output means for outputting a control signal for switching said switching element of said inverter means in accordance with an output from said comparing means, and reference signal generating means for generating the reference signal; and wherein said changing means changes the level of the reference signal corresponding to one of the plurality of rated consumption power change signals and said changing means further including a plurality of resistors interlocked with said reference signal generating means and a switch for switching the plurality of resistors.

2. An apparatus according to claim 1, wherein said control signal output means includes a sawtooth signal oscillator, a pulse width modulator for pulse-width-modulating an output from said sawtooth signal oscillator in accordance with the output from said comparing means, and a driver for driving said switching element of said inverter means in accordance with an output from said pulse width modulator, and said changing means changes the level of the output from said comparing means in accordance with one of the plurality of rated consumption power change signals.

3. An apparatus according to claim 1, wherein said high frequency heating source includes a magnetron.

4. An apparatus according to claim 3, wherein said magnetron is connected to said inverter means via a high voltage transformer and a rectifying circuit.

5. A method of controlling a high frequency heating apparatus including a magnetron and an inverter circuit for supplying a drive power to said magnetron, comprising the steps of:

manually changing and setting a rated consumption power of said apparatus to be a desired value; and controlling an output from said inverter circuit in accordance with the value set upon changing, said controlling step includes the steps of detecting an input to said inverter circuit, comparing an output based upon said input with a reference signal, and outputting a control signal for switching a switching element of said inverter circuit based upon an outcome of the comparing step.

* * * * *